US005282690A

United States Patent [19]

Moseley

[11] Patent Number: 5,282,690

[45] Date of Patent: Feb. 1, 1994

[54] FOLDABLE PULL-OUT INDEX CARD

[76] Inventor: Sharolyn A. Moseley, 2513 Morrison Ave., Tampa, Fla. 33629

[21] Appl. No.: 979,264

[22] Filed: Nov. 20, 1992

[51] Int. Cl.[5] ..... B42F 13/00

[52] U.S. Cl. ..... 402/79; 283/36; 40/360

[58] Field of Search ..... 402/79, 500; 281/42, 281/38; 283/36, 39, 41; 40/360

[56] References Cited

U.S. PATENT DOCUMENTS

| | | | |
|---|---|---|---|
| 4,849,056 | 7/1989 | Ristuccia, Sr. | 402/79 |
| 4,917,523 | 4/1990 | Merrick et al. | 402/79 |
| 5,020,931 | 6/1991 | Sloot | 402/79 |

FOREIGN PATENT DOCUMENTS

| | | | |
|---|---|---|---|
| 2609939 | 7/1988 | France | 402/79 |

*Primary Examiner*—Mark Rosenbaum
*Assistant Examiner*—Willmon Fridie, Jr.
*Attorney, Agent, or Firm*—John P. Halvonik

[57] ABSTRACT

The invention is a foldable pull-out, index card for use with business file card systems that typically use two rails in order to hold a series of business type cards in a file. The pull-out, index card may be used with a set of business cards as an index or table of contents for the rest of the cards in the file. The pull-out card has a front panel with two notched portions in the bottom edge to guide the card along the pair of rails in the business card file. A series of intermediate panels fold out above the front panel and contain printed information pertinent to the subject matter of other cards in the file. The back panel of the card may also have a pair of notched portions to further secure the fold-out card in the file.

4 Claims, 2 Drawing Sheets

FOLDABLE PULL-OUT INDEX CARD

FIELD OF INVENTION

1. Background of the Invention

The invention relates to the field of filing and organizing cards and, in particular, to business card filing systems that typically have a pair or rails running the length of the file in order to secure a series of cards through a pair of notches in the bottom of each card. The notched portions in each card secure the cards along the two rails and allow them to be moved along to find other cards. The index card to be described herein has a series of folded-up panels containing printed information in connection with a front panel and, optionally, a back panel having notched portions.

Business card files may be used for keeping various types of cards including: a series of business cards, or possibly, flash cards that may used to teach courses, such as real estate. The folded-up index card of this invention may then be used as an index or other sort of referencing card for the entire set of cards in the file be they business cards, flash cards, etc.

2. Description of the Prior Art

There are several companies that make business card files that typically have a pair of rails to hold the series of cards. While first made by Rolodex Corp. of Secaucus, N.J. under the trademark: ROLODEX, other companies such as Sterling and Emerson also make such cards that have notched portions in the bottom edges to fit into the rails of the business-card type file systems. No cards that applicant is aware of have a series of folded up panels that may then be folded or pulled up from a front panel as it rests in the file to reveal printed information. The use of such a folded up card as a master card or index for the entire set of cards in the file is also thought to be novel. Also, the folded up panels may be further folded sideways in order to fold out for further information.

SUMMARY OF THE INVENTION

The invention is a foldable pull-out index card for use with business-card type files that usually have a pair or rails or runners in the file to hold the series of cards in the file. The fold-out index card may be use as an index or table of contents for other cards in the file or simply as a card that has a lot more space for printed information than the typical card in the file. The pull-out card has a front panel having two notched portions in the bottom edge to guide the card along the pair of rails in the business card file. The back panel of the card may be doubled with a pair of notches in the fold line to make a thicker notch for additional securing of the card. Intermediate panels between the back and front panel do not have notches so they may fold up from the front panel to reveal further printed information. The intermediate panels should be shorter in height since they will not rest as deep in the file as the panels with the notches.

It is an object of the invention to provide a fold out card for a business card file system that may be folded out to store additional printed information than would normally fit on a single, double-sided business card.

Another object of the invention is to provide a fold out card for a business card file that can be used to store printed information relating to indexing or referencing a series of cards in the file.

Yet another objective is to provide a pull out business card for business card file systems that has a maximum amount of information stored in a minimal amount of space in the file system.

Other objectives of the invention will become apparent to those skilled in the art once the invention has been shown and described.

DESCRIPTION OF THE PREFERRED EMBODIMENT

Figure 4:
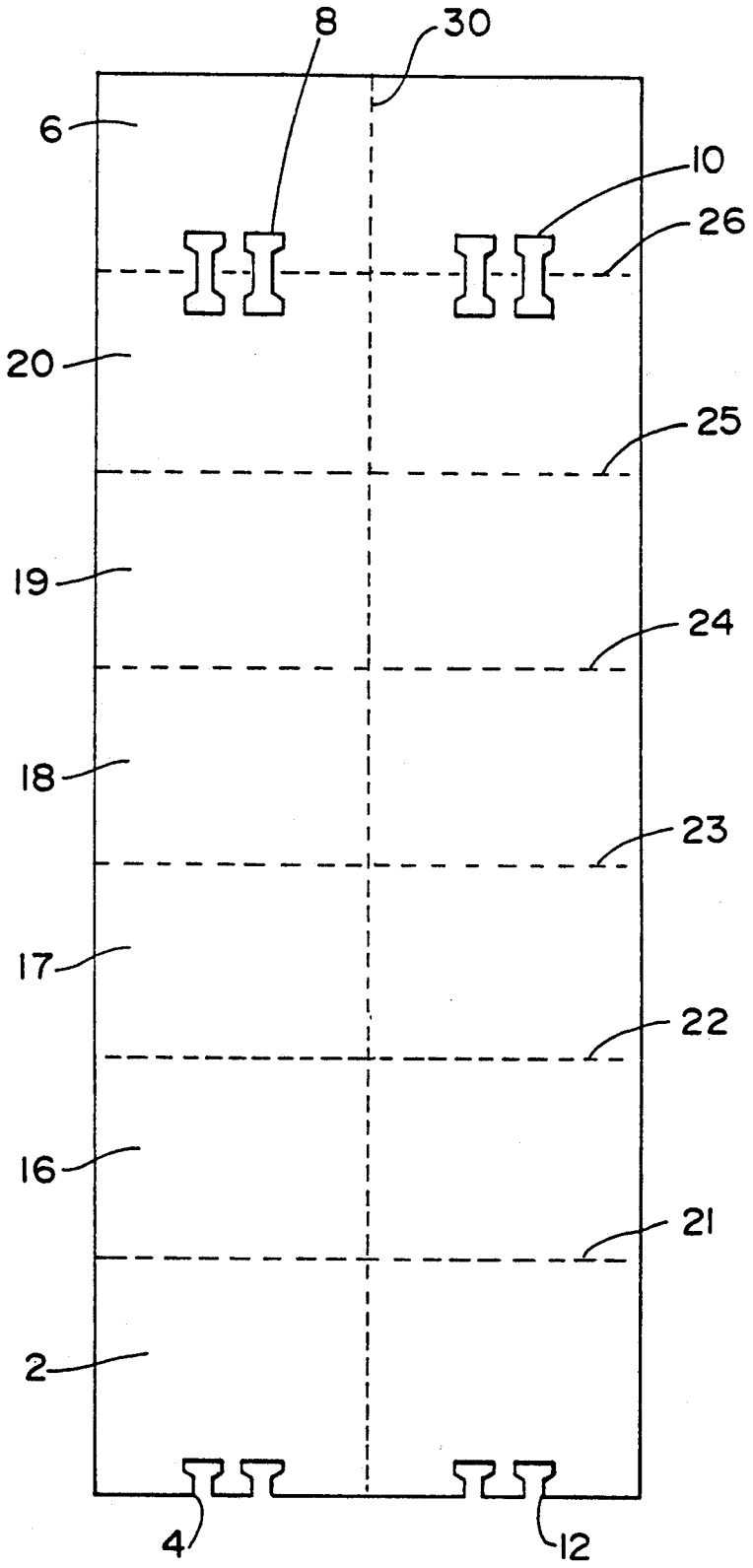
FIG. 4 Fold out card blank with back panel and doubled lengthwise.

The blank for the index card of the present invention is essentially as shown in FIG. 4. A series of fold lines 21–25 running across the width of the blank create a front panel 2 a back panel 6 and a series of intermediate panels 16–20. There will usually be an odd number of these fold lines in order that there be an even number of panels between the front set of holes 4 and rear set 8. This is so that the front and back panels will be oriented with their bottom edge downward to ride along the rails of the business card file.

The front panel has a pair of notches 4 in the bottom edge for sliding along the pair of rails in the business card file system. The back panel may also have a pair of similarly placed notches 8. Usually the rear pair of notches will be a symmetrical shape across the rear fold line 26 in order to double the thickness of these notches and provide additional securing of the fold out card. In that case the notch will not be in the bottom edge but rather in the middle of the panel, see FIG. 4.

It is also possible the rear pair of notches not be doubled and thus be of construction similar to the front pair of notches. In that case, the notch would be in the edge of the rear panel, this edge may be referred to as the upper edge to distinguish from the bottom edge where the front panel is located.

The invention should not be construed as limited to only file systems that have two rails, certainly it is possible that systems may be made with only one rail, or, more than two rails. That being the case, the fold out card may be made with one notch in the bottom edge of the front panel or more than two notches. Also, it is possible for the fold out card to function without the notches in the back panel, these are merely preferred for additional securing of the card.

Note that notch pairs 10 and 12 underlie the front and rear notches, however, they are optional as seen in FIG. 4 when a double width blank is used and folded along line 30. These additional notch pairs underlie the front and back notches when the card is in the file and may be seen in FIGS. 3 and 4.

Figure 1:
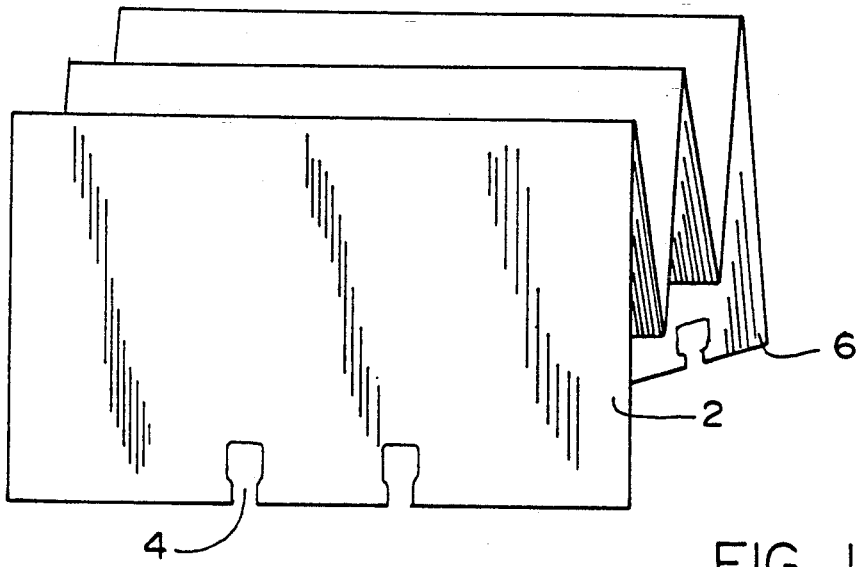
FIG. 1 Overall appearance of the front of the index card.
Figure 2:
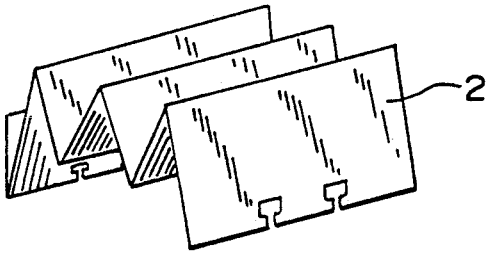
FIG. 2 Side view of fold-up index card.

The intermediate panels are not as long as the front and back panels. i.e. they do not extend all the way to the bottom of the file, see FIG. 2. This is unlike the front and back panels whose bottom edges are notched and thus slide along the rail at the bottom of the file. Thus the card sits in the file with intermediate portions resting above the rails.

Figure 3:
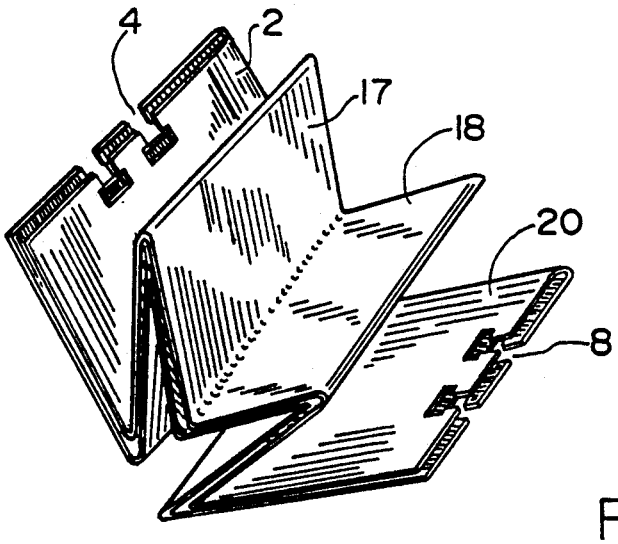
FIG. 3 Fold out view of intermediate panels of the card.

To use the index card one simply pulls the back panel up to fold out the intermediate portions, see FIG. 3.

Some or all of the panels (including the front and back panels) may contain printed matter to guide the user as to the organization of the remaining cards in the file. The printed matter may be e.g. an index to all the cards, or a table of contents, or some other system of reference. Of course other uses are possible for the fold out cards, they simply provide additional space for printed matter. The printed matter may be on both sides of the blank, front and back as well as on the right and left sides of the blank shown in FIG. 4.

The card may also be made with a double width having a lengthwise fold 30 which divides the panels in two. A second set of notches 10 and 12 should also be used to correspond to the original notches. The use of a lengthwise fold provides additional material for indexing and also provides additional stiffness.

The notches in the front and the back panel of the index card do not necessarily have to be along one edge of the card. As seen in FIG. 3 and FIG. 4 one of the panels, in this case the back one, may be constructed with symmetrical notches 8 made along both sides of an additional, widthwise fold 26. As the card is folded along this fold (known as the rear fold 26), the notch becomes doubled (there are now two notches on each side of the fold line). This creates two panels 6, 20 out of the rear panel and gives additional stability to the back panel of this card in the file.

It should of course be understood that the number of fold lines may vary with the proviso that there should be an odd number of widthwise fold lines between the back and front panels of the blank in order that bottom edges of the front and back panel be alongside the rail. The number of folds would be even if the fold 26 in the rear panel is counted. It is also possible to vary the number of lengthwise folds 30, the example shown should not imply that only one lengthwise fold may be made.

The preferred size of the card would be about 4" wide and the front panels should be about 2¾" long and the intermediate panels should be about 2⅛" long. Of course other sizes may be made to fit the various sizes of filing systems.

I claim:

1. A foldable pull-out index card for use with index card filing systems having at least one rail, said index card comprising: blank made of printable material having a bottom edge and an upper edge and having at least two fold lines across the width of said blank so as to form a front panel bordered by said bottom edge and a first fold line and a back panel bordered by said upper edge and a final fold line, and at least one intermediate panel bordered by said fold lines, at least one notch in said bottom edge for sliding contact with said rail and said rear panel having at least one notch for contact with said rail, said card having printed information on at least one of said panels.

2. The apparatus of claim 1 wherein said rear panel has a notch in said upper edge for contact with said rail.

3. The apparatus of claim 2 wherein the distance between said fold lines is less than that between said first fold line and said bottom edge and also less than the distance between said final fold line and said upper edge.

4. The apparatus of claim 2 wherein said rear panel has a notch in said final fold line for contact with said rail.

* * * * *